United States Patent [19]

Leitao

[11] Patent Number: 5,040,798

[45] Date of Patent: Aug. 20, 1991

[54] CHIPPING AND PUTTING PRACTICE DEVICE

[76] Inventor: Joseph F. Leitao, 500 Foggy Ridge Pkwy., Lutz, Fla. 33549

[21] Appl. No.: 626,013

[22] Filed: Dec. 12, 1990

[51] Int. Cl.[5] ..... A63B 69/36

[52] U.S. Cl. ..... 273/183 B; 273/189 R; 273/183 E

[58] Field of Search ..... 119/126, 127, 128; 273/188 R, 189 R, 189 A, 183 R, 183 A, 183 B, 183 E

[56] References Cited

U.S. PATENT DOCUMENTS 765,354 7/1904 Boone ..... 119/127

3,672,682 6/1972 Yanagidaira ..... 273/189 R

FOREIGN PATENT DOCUMENTS 20463 of 1907 United Kingdom ..... 273/189 R

*Primary Examiner*—George J. Marlo

[57] ABSTRACT

A chipping and putting practice device which includes a shaft and two arm attachment loops, which allows the practice device to be attached to the golfers arms, with the shaft laying across the inside portion of both elbows, so that the proper alignment of the forearms, elbows and shoulders to the intended target line can be obtained.

This practicing device was designed and created to help the golfer achieve the movement and therefore the feeling of a one piece swing, which is coordinated and controlled by the large muscles of the upper body, encouraging the golfer to take the club straight back and then straight through the ball, with the shoulders, arms, hands and club acting as a single unit.

2 Claims, 1 Drawing Sheet

CHIPPING AND PUTTING PRACTICE DEVICE

BACKGROUND OF THE INVENTION

1. Field of the Invention

This invention relates to a training device for practicing golf skills, more specifically, this invention relates to a training device used in teaching and practicing effective chipping and putting techniques.

2. Prior Art

Fear of chipping and putting is common among experienced and inexperienced golfers alike. In the past chipping and putting has been taught by explanation and demonstration of the proper techniques, by golf instructors.

In order to provide background information, so that the invention may be completely understood and appreciated, reference is made to several prior art patents.

U.S. Pat. No. 3,672,682 to Yanagidaira, discloses a stabilizer plate, which is held in place by the Golfers arms.

U.S. Pat. No. 4,896,887 to Cable, discloses a golfing aid using two arm restraints, each of which is located on opposite sides of a yoke, thus placing the forearm and elbow of one arm above the forearm and elbow of the other, causing the leading shoulder to become higher than the trailing shoulder.

Whatever the precise merits, features and advantages of the above cited references, none of them achieve the proper alignment of the forearms, elbows and shoulders to the intended target line without any unnecessary muscle force.

The object of the present invention is a practicing device for improving the alignment of the forearms, elbows and shoulders to the intended target. This is accomplished by attaching the practice device to the golfers arms, with the shaft laying across the inside portion of both elbows, and by visibly leveling the shaft and checking to make sure it is parallel to the intended target. The golfers arms and shoulders are now in the correct position to take the club away from the ball as a single unit, in what is known as a one piece take-a-way. This swing is created with the use of the large muscles of the upper body, the golfer will now create a pendulum motion with the shoulders, arms and club, necessary for a one piece swing straight back and then straight through the ball.

The present invention aids in the development of the desired one piece swing movement, maintaining the forearms, elbows and shoulders in proper alignment to the intended target line, for a more uniform and accurate stroke, all of which are key elements in effective chipping and putting.

Summary of the Invention

The principal object of this invention is to provide a training device for use in training golfers in effective chipping and putting techniques. This can be accomplished by providing a training device comprising a rigid elongated shaft and two means for attaching the shaft to the golfers arms. The attachment means are comprised of two flexible elastic cord loops which are spaced on the same side of the shaft so that when the practicing device is attached to the golfers arms the shaft will lay across the inside portion of both elbows, which encourages the golfers forearms, elbows and shoulders to be placed in proper alignment position, to the intended target, when the golfer is addressing the ball. In this proper position the golfer utilizes the large muscles of the upper body to take the shoulders, arms and club away from the ball as a single unit, in what is known as a one piece take a way. In order to allow for adjustments to compensate for the golfers physical stature a series of holes may be added to the shaft to allow for the repositioning of one of the arm attachments loops.

It also is an object of the present invention to provide such a training device which is of simple, lightweight, inexpensive construction.

Further objects and advantages of my invention will become apparent from a consideration of the drawings and the written description that follow.

DETAILED DESCRIPTION OF THE INVENTION

Figure 1:
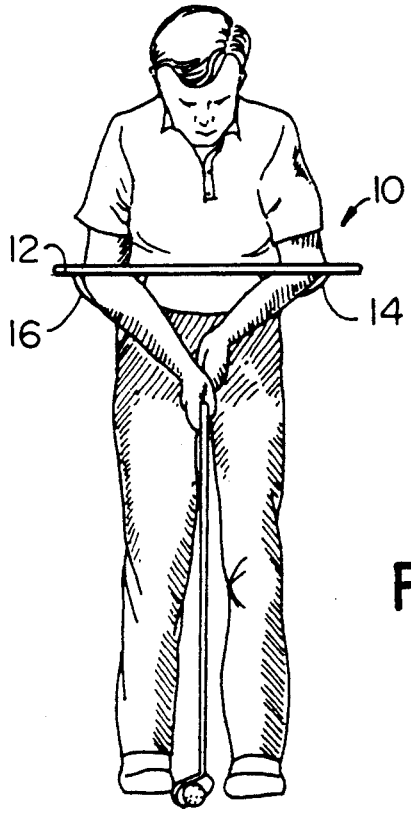
FIG. 1 is a sketch illustrating a manner in which the present invention is used for its intended purpose.
Figure 2:
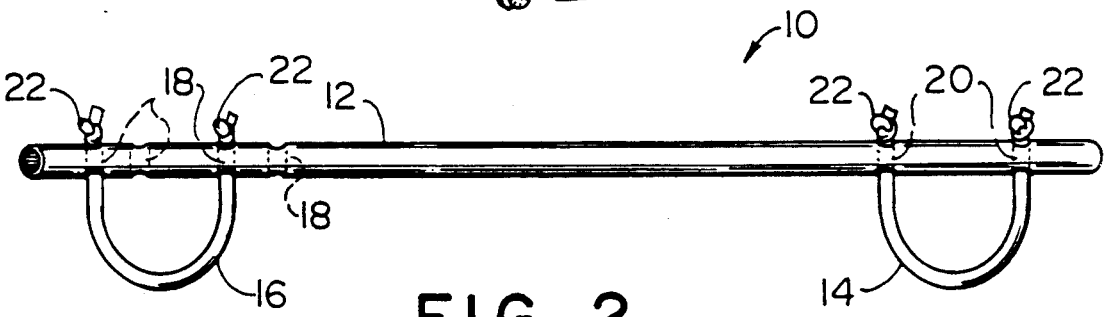
FIG. 2 is a front elevational view of a first embodiment of the present invention.
Figure 3:
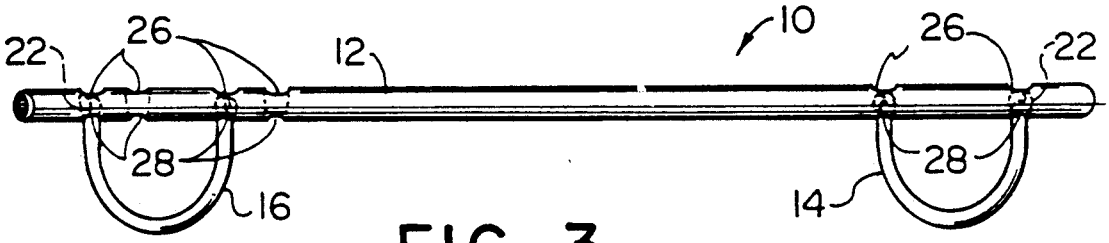
FIG. 3 is a front elevational view of a second preferred embodiment of the present invention.
Figure 4:
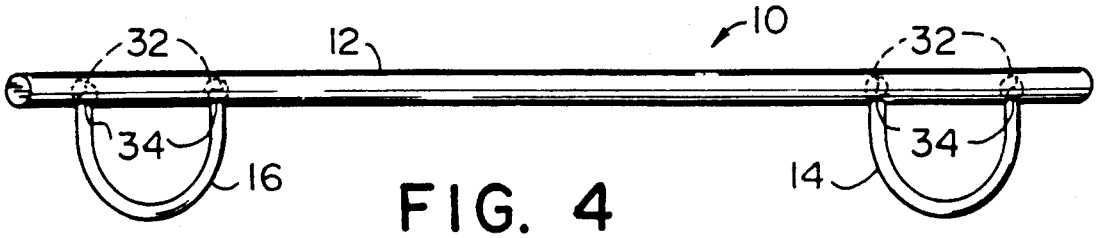
FIG. 4 is a front elevational view of a third embodiment of the present invention.

FIG. 1 shows the chipping and putting practice device of the invention designated generally as 10. The practice device 10, as shown in FIG. 2 includes an elongated shaft 12, which is composed of a rigid, lightweight material, either hollow or solid in nature, from which two loops 14 and 16 are attached. Each loop is made from flexible elastic cord material. The loops are spaced along the same side of the shaft, with loop 14 attached near one end of the shaft and loop 16 on the other end. The distance between the loops may be a fixed dimension or may be made adjustable with a series of holes 18 allowed to adjust the longitudinal distance between loops 14 and 16, in order to suit the physical stature of the golfer. The ends of loops 14 and 16 shall pass through the shaft through holes 18 and 20 with the ends being tied off 22 once the exact length of each loop has been determined, which will securely fit the golfers arms. FIG. 3 shows a second embodiment of this practice device, includes a shaft 12 which is composed of a rigid, hollow, lightweight material, from which two loops 14 and 16 are attached. Each loop being made from a flexible elastic cord material. The loops are located on the shaft by any of the previously mentioned method. Holes 26 will have a larger diameter than holes 28 in so that the tied off ends 22 of each loop shall be allowed to slip back into the shaft so as to be concealed. FIG. 4 is an alternate embodiment of the present invention, includes an elongated shaft 12, which is composed of a solid, rigid, lightweight material, from which two loops 14 and 16 are attached. Each loop being made from a flexible elastic cord material, the loops are located on the same side of the shaft as previously mentioned, only now the distance between the loops is fixed, the ends 32 are now glued into holes 34.

In use, the practice device is positioned as shown in FIG. 1 with the shaft 12 laying across the inside portion of both elbows. The loops 14 and 16 merely act as a device to hold the shaft in place on the golfers arms, to maintain each corresponding forearm, elbow and shoulder in a symmetrical/mirror image position relative to the corresponding forearm, elbow and shoulder on the opposite side of the body such that said device restricts relative movement between corresponding forearms, elbows and shoulders to maintain the club shaft in a substantially vertical position throughout the entire stroke.

An invention has been provided with several advantages. The practice device of the invention which can be used by both right and left handed golfers, is a device for improving the proper alignment of the forearms, elbows and shoulders to the intended target. By visibly leveling the shaft and also checking to make sure it is parallel to the intended target, the golfers arms and shoulders are now in the correct position to take the club away from the ball as a single unit. The stroke is created with the use of the large muscles in the upper body, causing the golfer to create a pendulum motion with the shoulders, arms and club, all of which are key elements in effective chipping and putting.

There has thus been shown and described what are considered at present to be the preferred embodiments of the present invention, it will be appreciated by those skilled in the art that modifications of such embodiments may be made. It is therefore desired that the invention not be limited to these embodiments, and it is intended to cover in the appended claims all such modifications as fall within the true spirit and scope of the invention.

What is claimed is:

1. A chipping and putting practive device comprising: an enlongated rigid shaft including a leading and trailing end, said leading and trailing end each having a flexible elastic loop attached inwardly from opposite end portions to receive the golfer's arms therethrough, said elongated rigid shaft having a length permitting same to lay across the inside portion of each elbow while the golfer is addressing a golf ball for a chipping or putting stroke such that each corresponding forearm, elbow and shoulder is held in a symmetrical/mirror image position relative to the corresponding forearm, elbow and shoulder on the opposite side of the body to prevent relative movement between corresponding forearms, elbows and shoulders whereby the golfer creates a one piece take-a-way stroke by movement of the upper portion of the golfer's body.

2. A chipping and putting practive device comprising: an elongated rigid shaft including a leading and trailing end, said leading and trailing end each having a flexible elastic loop attached inwardly from opposite end portions to receive the golfer's arms therethrough, said elongated rigid shaft having a length permitting same to lay across the inside portion of each elbow while the golfer is addressing a golf ball for a chipping or putting stroke such that each corresponding forearm, elbow and shoulder is held in a symmetrical/mirror image position relative to the corresponding forearm, elbow and shoulder on the opposite side of the body to prevent relative movement between corresponding forearms, elbows and shoulders whereby the golfer creates a one piece take-a-way stroke by movement of the upper portion of the golfer's body; said leading end portion extending outwardly of the golfer's leading elbow to provide visual alignment of said elongated rigid shaft in a line parallel to the line between the ball and the cup.

* * * * *